US008311437B2

(12) United States Patent
Sato

(10) Patent No.: US 8,311,437 B2
(45) Date of Patent: Nov. 13, 2012

(54) IMAGE FORMING APPARATUS WITH DETACHABLE CARTRIDGE

(75) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1011 days.

(21) Appl. No.: 12/255,689

(22) Filed: Oct. 22, 2008

(65) Prior Publication Data

US 2009/0142092 A1 Jun. 4, 2009

(30) Foreign Application Priority Data

Dec. 4, 2007 (JP) ..... 2007-313887
Dec. 24, 2007 (JP) ..... 2007-335627

(51) Int. Cl.
*G03G 15/00* (2006.01)

(52) U.S. Cl. ..... 399/90; 399/88; 399/110

(58) Field of Classification Search ..... 399/88–90, 399/110, 118, 125
See application file for complete search history.

(56) References Cited

U.S. PATENT DOCUMENTS

| | | | | |
|---|---|---|---|---|
| 5,201,854 | A * | 4/1993 | Ahl et al. | 439/247 |
| 6,708,011 | B2 | 3/2004 | Nomura et al. | |
| 6,721,521 | B2 | 4/2004 | Kataoka et al. | |
| 2001/0019418 | A1 | 9/2001 | Kataoka et al. | |
| 2006/0067734 | A1 | 3/2006 | Igarashi et al. | |
| 2009/0169228 | A1 * | 7/2009 | Yokoi et al. | 399/51 |

FOREIGN PATENT DOCUMENTS

| | | | |
|---|---|---|---|
| JP | 2-285366 | A | 11/1990 |
| JP | 05-072867 | A | 3/1993 |
| JP | 08-036346 | | 2/1996 |
| JP | 2000-010408 | A | 1/2000 |
| JP | 2001-249517 | A | 9/2001 |
| JP | 2001-249522 | A | 9/2001 |
| JP | 2002-006588 | A | 9/2002 |
| JP | 2003-043776 | | 2/2003 |
| JP | 2006-098772 | | 4/2006 |
| JP | 2006-171534 | A | 6/2006 |
| JP | 2007-069528 | A | 3/2007 |

OTHER PUBLICATIONS

JP Office Action dtd Nov. 4, 2009, JP Appln. 2007-313887, English translation.
JP Office Action dtd Mar. 2, 2010, JP Appln. 2007-313887, English Translation.

* cited by examiner

*Primary Examiner* — Joseph S Wong
(74) *Attorney, Agent, or Firm* — Banner & Witcoff, Ltd.

(57) ABSTRACT

A color multifunction printer as one example of an image forming apparatus includes a plurality of cartridges each contains a photoconductor; a support frame configured to support the cartridges arranged in tandem, the support frame being allowed to be pulled out horizontally from a casing of the apparatus to a position in which each of the cartridges is detachable from the support frame; and a plurality of exposure units mounted to the support frame, wherein each of the exposure units is disposed opposite to the corresponding photoconductor and is configured to expose the photoconductor to light, thereby forming an electrostatic latent image thereon. Each of the cartridges is configured to be detachable in such a direction that the photoconductor in the cartridge moves away from the corresponding exposure unit upon detachment.

7 Claims, 9 Drawing Sheets

IMAGE FORMING APPARATUS WITH DETACHABLE CARTRIDGE

CROSS-REFERENCE TO RELATED APPLICATION(S)

This application claims the foreign priority benefit under Title 35, United States Code, §119 (a)-(d), of Japanese Patent Application Nos. 2007-313887 and 2007-335627, filed on Dec. 4, 2007 and Dec. 24, 2007, respectively, in the Japan Patent Office, the disclosure of which is herein incorporated by reference in its entirety.

BACKGROUND OF THE INVENTION

1. Field of the invention

The present invention relates to an image forming apparatus which includes exposure units each disposed opposite to a corresponding photoconductor.

2. Description of related art

Among image forming apparatuses for forming an image on a recording sheet, the so-called tandem type image forming apparatus is known in the art (e.g., see patent documents 1-3 listed below) which typically includes exposure units arranged in tandem and each disposed above and opposite to a corresponding photoconductor. The exposure units may be LED heads, for example, which use light-emitting diodes (LEDs) as a light source for forming an electrostatic latent image on a photoconductor. Varieties of such image forming apparatus known in the art include, for example: type I (as disclosed in patent document 1) in which a frame on which cartridges each containing a photoconductor are supported is slid upward to render any of the cartridges replaceable; and type II (as disclosed in patent documents 2 and 3) in which cartridges each containing a photoconductor or a frame on which the cartridges are supported can be pulled out horizontally for replacement of the cartridges.

<Cited Reference Documents>

Patent document 1: JP 2003-43776 A (see FIG. 3); corresponding U.S. patent issued under U.S. Pat. No. 6,708,011 B2

Patent document 2: JP 8-36346 A (see FIG. 3)

Patent document 3: JP 2006-98772 A (see FIG. 13); corresponding U.S. patent application published under US 2006/067734 A1

In the conventional image forming apparatuses, each exposure unit (LED unit) is disposed above and opposite to the corresponding photoconductor, and thus special consideration in designing the apparatus used to be given to a path along which each cartridge is removed from or attached to the apparatus, particularly in view of the operation carried out when a cartridge containing a photoconductor is replaced. For example, the path is so designed as to avoid a space being occupied by the exposure unit; alternatively, each exposure unit is configured to be moved away from the path (from above the corresponding cartridge) every time when the cartridge is replaced. This would presumably be detrimental to the convenience of operation.

It would thus be desirable to provide an image forming apparatus having an exposure unit disposed opposite to a photoconductor, in which the operability in replacement of a cartridge containing a photoconductor is improved. The present invention has been made in an attempt to eliminate the above disadvantages. Illustrative, non-limiting embodiments of the present invention overcome the above disadvantages and other disadvantages not described above. Also, the present invention is not required to overcome the disadvantages described above, and an illustrative, non-limiting embodiment of the present invention may not overcome any of the problems described above.

SUMMARY OF THE INVENTION

In one aspect of the present invention, an image forming apparatus comprises a plurality of cartridges each of which comprises a photoconductor; a support frame configured to support the cartridges arranged in tandem; and a plurality of exposure units mounted to the support frame. The support frame is allowed to be pulled out from a casing of the apparatus to a position in which each of the cartridges is detachable upwardly from the support frame. Each of the exposure units is disposed below and opposite to the corresponding photoconductor and is configured to expose the photoconductor to light, thereby forming an electrostatic latent image thereon.

In such an image forming apparatus consistent with the present invention, each cartridge which comprises a photoconductor is configured to be detachable in such a direction that the photoconductor in the cartridge moves away from the corresponding exposure unit upon detachment from the support frame configured to be pulled out horizontally from the casing of the apparatus. Therefore, it is not necessary to move the exposure unit away for replacement of the cartridge. In other words, the cartridge can be so positioned that it is detachable from and attachable to the support frame, only through a simple operation of pulling out the support frame from the casing of the apparatus.

According to the specific embodiments of the present invention, each cartridge which comprises a photoconductor is configured to be detachable in such a direction that the photoconductor in the cartridge moves away from the corresponding exposure unit upon detachment from the support frame, and thus the operational ease of the cartridge comprising an exposure unit upon replacement can be improved considerably.

BRIEF DESCRIPTION OF THE DRAWINGS

The above aspects and advantages, other advantages and further features of the present invention will become more apparent by describing in detail illustrative, non-limiting embodiments thereof with reference to the accompanying drawings, in which.

DETAILED DESCRIPTION OF THE EXEMPLARY EMBODIMENTS

Figure 1:
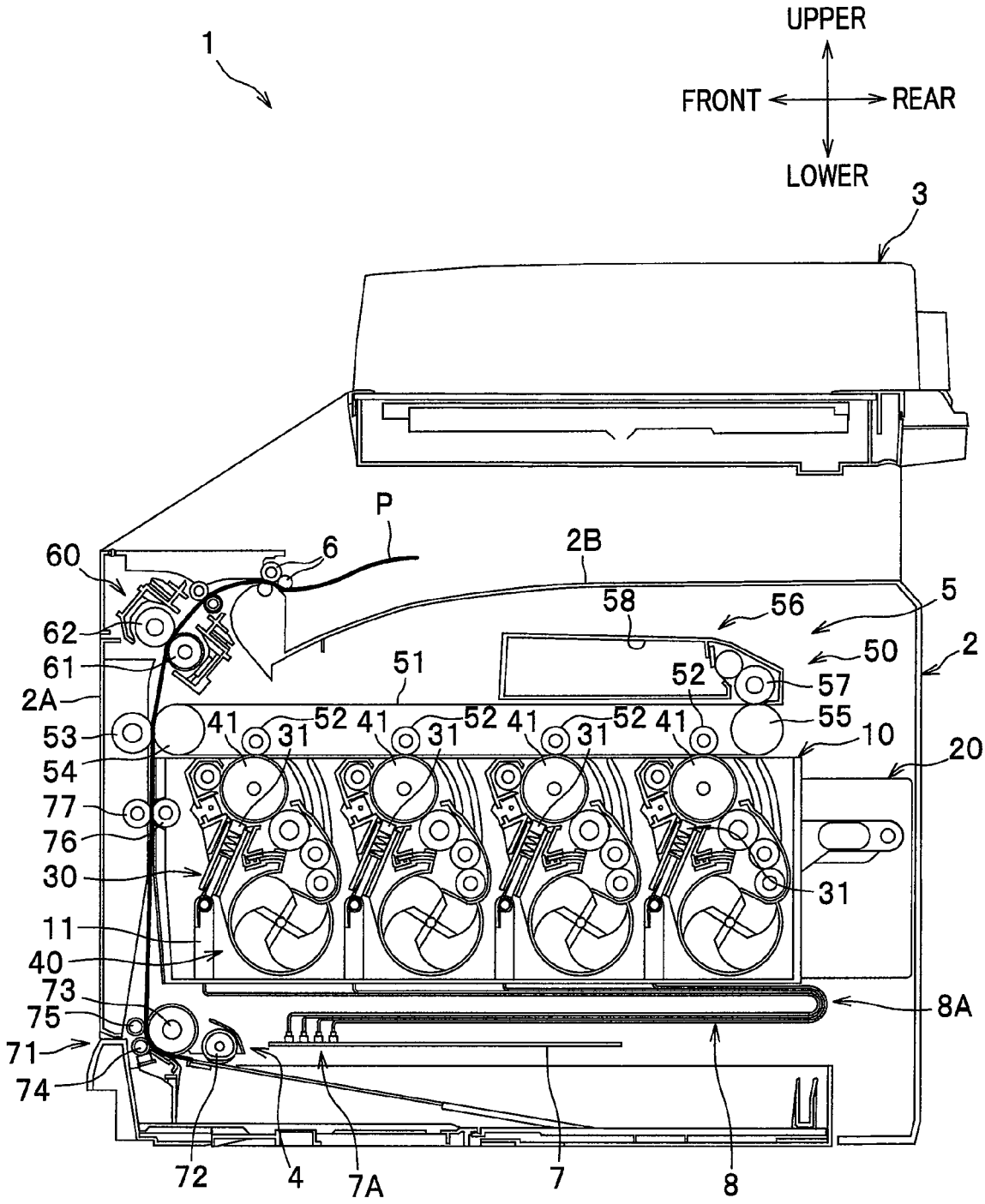
FIG. 1 is a sectional view showing a general construction of a color multifunction printer as an example of an image forming apparatus according to one exemplary embodiment of the present invention.

A detailed description will be given of one exemplary embodiment of the present invention with reference to the drawings. In the following description, the direction is designated as from the viewpoint of a user who is using (operating) a color multifunction printer. To be more specific, in FIG. 1, the left side of the drawing sheet corresponds to the "front side" of the color multifunction printer (image forming apparatus), and the right side of the drawing sheet corresponds to the "rear side" of the printer; the back side of the drawing sheet corresponds to the "left side" of the printer, and the front side of the drawing sheet corresponds to the "right side" of the printer. Similarly, the direction of a line extending from top to bottom of the drawing sheet corresponds to the "vertical direction" of the printer.

As shown in FIG. 1, a color multifunction (or all-in-one) printer 1 principally includes a body casing 2 which makes up a housing of the main body of the printer 1, and a flatbed scanner 3 provided above the body casing 2. The color multifunction printer 1 further comprises, within the body casing 2, a sheet feeder unit 4, an image forming unit 5, a sheet output roller 6, a control circuit board 7 and a set of cables (wiring) 8. The sheet feeder unit 4 is configured to feed a sheet P of paper as one example of a recording sheet to the image forming unit 5. The image forming unit 5 is configured to form an image on a sheet P fed from the sheet feeder unit 4. The sheet output roller 6 is configured to eject a sheet P on which an image has been formed. The control circuit board 7 is configured to control each of LED heads 31 (exposure units). The cables 8 are arranged to electrically connect each LED head 31 with the control circuit board 7.

Figure 2:
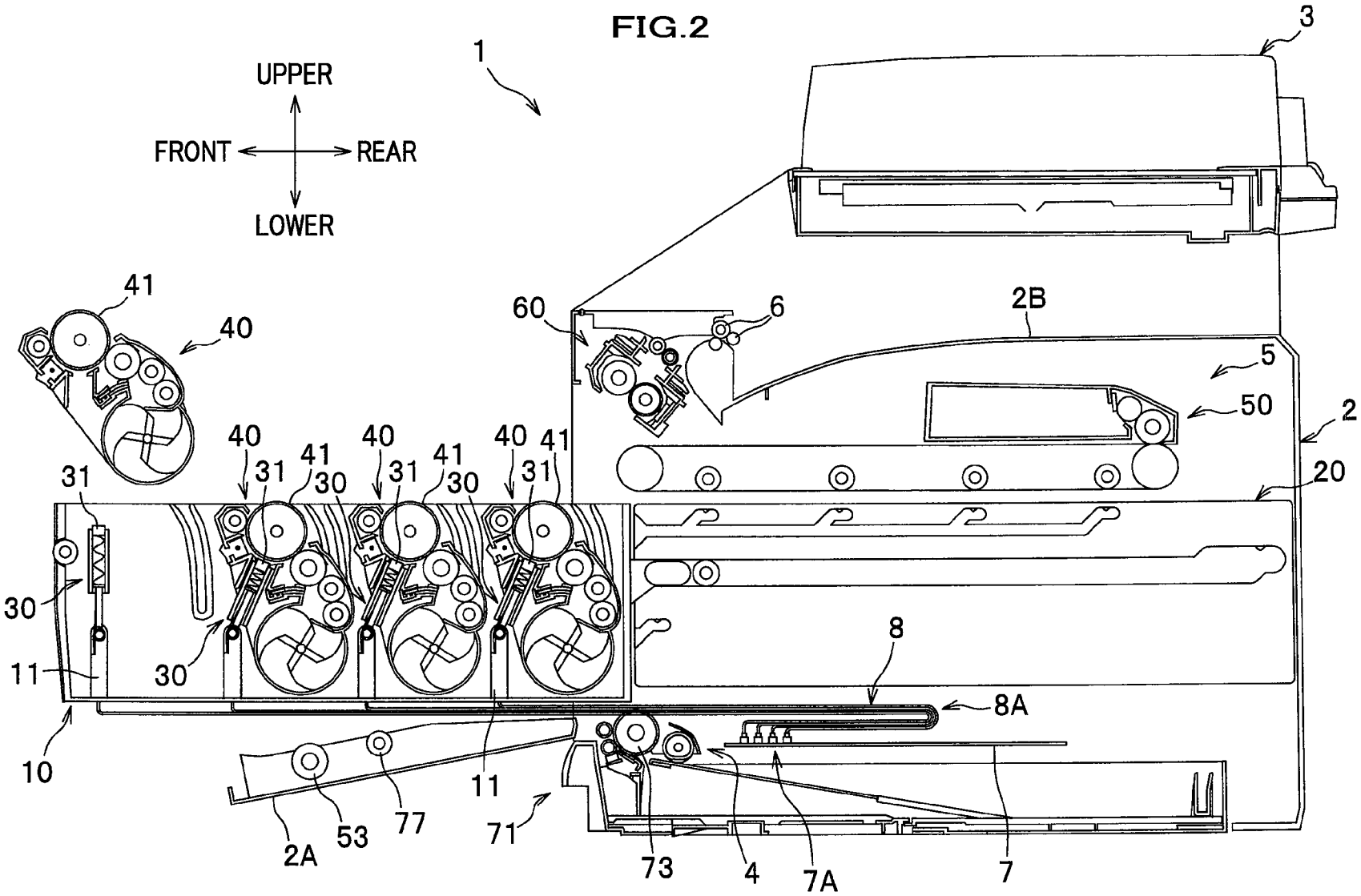
FIG. 2 is a sectional view showing the color multifunction printer of which a support frame has been pulled out.

As shown in FIG. 2, at the front side of the body casing 2, a front cover 2A as one example of an openable cover is provided in such a manner as to swing open forward and closed backward about a supporting axis (pivot) located in a lower portion of the front cover 2A. At the top side of the body casing 2, a sheet output tray 2B is provided which is configured to receive sheets P ejected one by one from the body casing 2 so that the ejected sheets P are stacked and accumulated in the sheet output tray 2B. Also provided in the body casing 2 are a support frame 10 which is a member for supporting each process cartridge 40 in such a manner that each process cartridge 40 can be attached to and detached from the support frame 10, and side frames 20 which are members for supporting the support frame 10 in such a manner that the support frame 10 can be pulled out from the front side of the body casing 2, the side frames 20 being fixed to the body casing 2 to constitute part of the main body of the printer 1. Specific structures of the support frames 10 and the side frame 20 will be described later in detail.

The flatbed scanner 3 is an image reader having a mechanism known in the art. When the flatbed scanner 3 is operated for use in photocopying a document or other purposes, the flatbed scanner 3 illuminates the document having an image thereon with light to read the image from the document, thereby creating image data from the read image.

As shown in FIG. 1, the sheet feeder unit 4 principally includes a sheet feed cassette 71, a separation roller 72, sheet feed rollers 73-75, a first conveyor roller 76, and a second conveyor roller 77. The sheet feed cassette 71 is provided in a lower space within the body casing 2, and is detachably attached to the body casing 2. The separation roller 72 and the sheet feed rollers 73-75 are provided in a space allotted above a front end portion of the sheet feed cassette 71 within the body casing 2. The first conveyor roller 76 is provided at the front side of the support frame 10. The second conveyor roller 77 is disposed opposite to the first conveyor roller 76 and is provided at the back of the front cover 2A. One sheet P at the top of the sheets P in the sheet feed cassette 71 is separated from the remaining sheets P by the separation roller 72 and fed upward one after another by the sheet feed rollers 73-75. Each sheet P fed upward passes between the first conveyor roller 76 and the second conveyor roller 77, and is then passed into the image forming unit 5 (between an intermediate transfer belt 51 and a secondary transfer roller 53).

The image forming unit 5 principally includes four LED units 30, four process cartridges 40 as one example of a plurality of cartridges, a transfer unit 50 and a fixing unit 60.

Figure 3:
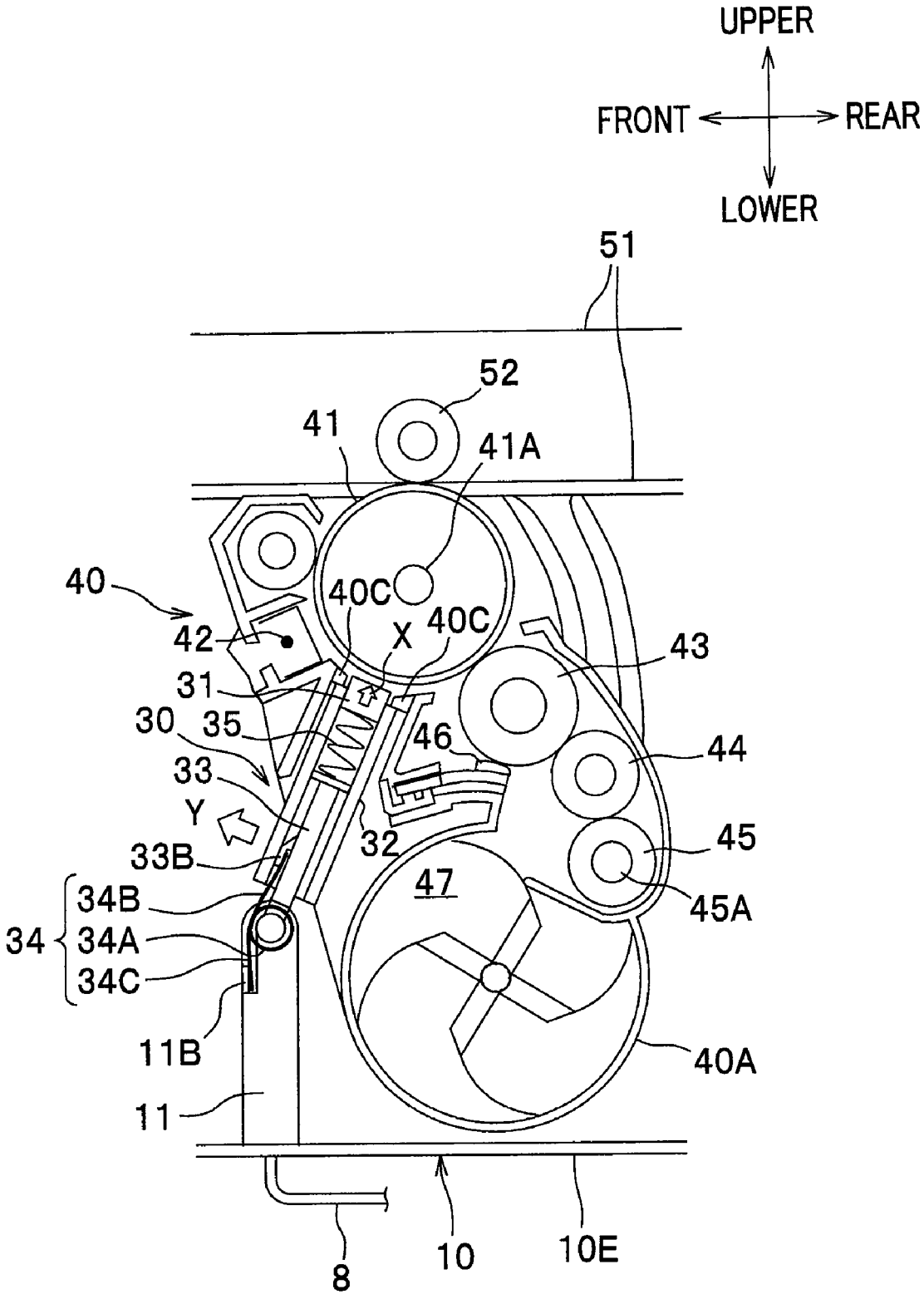
FIG. 3 is an enlarged view showing an LED unit and a process cartridge illustrated in FIG. 1.

Each of the LED units 30 principally includes, as shown in FIG. 3, an LED head 31 as one example of an exposure unit, a frame part 32, an arm part 33, a torsion spring 34 as one example of a first biasing element, and a coil spring 35 as one example of a second biasing element. Each LED head 31 is disposed below and opposite to a corresponding photoconductor drum 41.

The LED head 31 has a plurality of light-emitting diodes or LEDs (not shown) arranged laterally on a side thereof facing toward the photoconductor drum 41 (photoconductor). Each LED is configured to receive from the control circuit board 7 a signal corresponding to data (image data) indicative of an image to be formed, then emitting light, so as to expose the photoconductor drum 41 to light emitted in accordance with the image data.

The frame part 32 is a part made of resin or plastic and shaped like a cylinder having an opening at an upper end thereof, in which opening the LED head 31 is fitted and fixed so as to close the opening.

Figure 4:
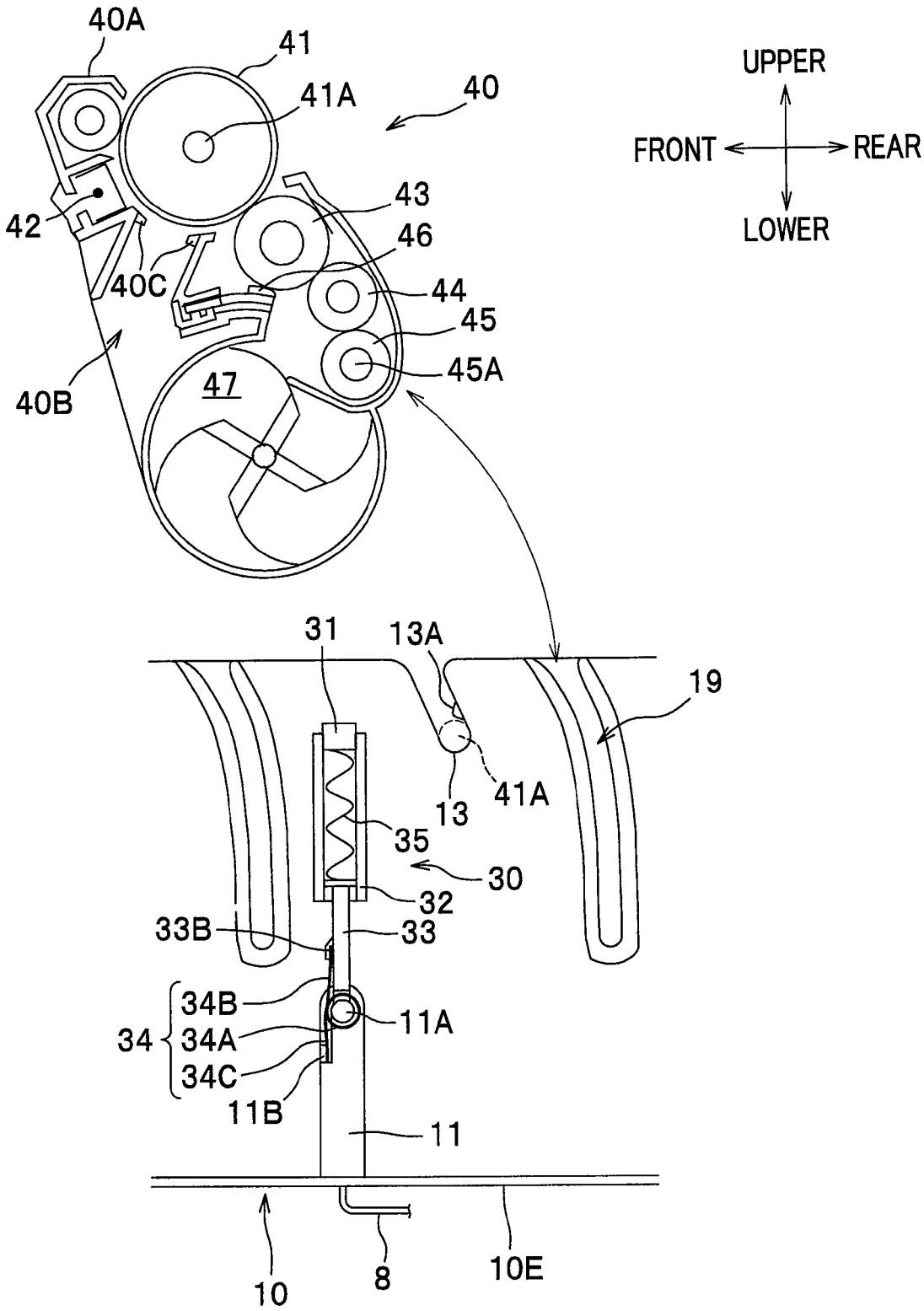
FIG. 4 is a diagram showing the LED unit as seen when the process cartridge has been detached from the support frame.

As shown in FIG. 4, the arm part 33 has a lower end portion pivoted on an upper end portion of a support stand 11 of which a lower end is fixed to the support frame 10 so that the arm part 33 can tilt (or swing) to the front or to the rear on a pivot 11A. Around the pivot 11A, a coiled portion 34A of the torsion spring 34 is wound helically. Two spring arms 34B and 34C extending from the ends of the coiled portion 34A of the torsion spring 34 are held by a retainer 33B provided in the arm part 33 and a retainer 11B provided in the support stand 11, respectively.

With this configuration, when the process cartridge 40 shown in FIG. 3 is attached to the support frame 10, the retainers 33B and 11B exert forces on the spring arms 34B and 34C, so that the arm part 33 (LED unit 30) is biased toward a direction indicated by an arrow Y in FIG. 3. As shown in FIG. 4, when the process cartridge 40 is detached from the support frame 10, the upper end (LED head 31) of the arm part 33 moves back to its original upright position.

The upper end of the arm part 33 is inserted in the frame part 32 through the opening provided at the lower end of the frame part 32, and the frame part 32 is configured to be slidable longitudinally (vertically in FIG. 4) relative to the arm part 33. A coil spring 35 is provided between the arm part 33 and the LED head 31 fixed to the frame part 32.

The process cartridges 40 are, as shown in FIG. 1, disposed between the sheet feeder unit 4 and the sheet output tray 2B, arranged in tandem in the longitudinal (front-rear) direction of the support frame 10 and each detachably supported on the support frame 10. Each of the process cartridges 40 principally includes, as shown in FIG. 3, a photoconductor drum 41 as one example of photoconductor, a scorotron charger 42, a development roller 43, a first supply roller 44, a second supply roller 45, a doctor blade 46 and a toner container 47, all of which are enclosed within a cartridge frame 40A which constitutes an outer shell of the process cartridge 40. The photoconductor drum 41 and the second supply roller 45 have a shaft 41A and a shaft 45A, respectively, which protrude outwardly from the right and left sides of the cartridge frame 40A (see FIG. 6). The process cartridges 40 are different from one another solely in color of toner to be stored within the respective toner containers 47, and have substantially the same construction.

The transfer unit 50 principally includes, as shown in FIG. 1, an intermediate transfer belt 51, four primary transfer rollers 52, a secondary transfer roller 53, a driving roller 54, a driven roller 55, and a cleaning unit 56, which are arranged between a tandem array of the process cartridges 40 and the sheet output tray 2B.

The driving roller 54 and the driven roller 55, each of which is laid with its axis extending laterally, are arranged apart from and parallel to each other above a front end portion and a rear end portion of the support frame 10 respectively within the body casing 2, and the intermediate transfer belt 51 made up of an endless belt is looped around the driving roller 54 and the driven roller 55. The intermediate transfer belt 51 has its outer face kept in contact with each photoconductor drum 41 disposed below and opposite to the intermediate transfer belt 51. The outer face of the intermediate transfer belt 51 is also kept in contact with the secondary transfer roller 53 disposed on a front side of and opposite to the intermediate transfer belt 51.

Each primary transfer roller 52 provided inside the intermediate transfer belt 51 and in contact with an inner face of a lower portion of the endless belt 51 is disposed directly opposite to a corresponding photoconductor drum 41, with the intermediate transfer belt 51 held between the primary transfer roller 52 and the corresponding photoconductor drum 41. The secondary transfer roller 53 is disposed directly opposite to the driving roller 54 with the intermediate transfer belt 51 held between the second transfer roller 53 and the driving roller 54. The secondary transfer roller 53 is attached to the front cover 2A. A transfer bias is applied to the primary and secondary transfer rollers 52, 53 by a constant current control during a transfer operation.

The cleaning unit 56 is disposed in a rear-side space within the body casing 2 above the intermediate transfer belt 51, and is configured such that toner remaining on and adhering to the intermediate transfer belt 51 is removed therefrom by a cleaning roller 57, and thus-removed toner is stored in a toner reservoir 58 disposed frontward of the cleaning roller 57.

The fixing unit 60 is disposed in a front-side space within the body casing 2 above the intermediate transfer belt 51, and principally includes a heating roller 61, and a pressure roller 62 which is disposed opposite to the heating roller 61 and configured to press the heating roller 61.

In the image forming unit 5 configured as described above, first, an outer cylindrical surface of each photoconductor drum 41 is uniformly charged by the corresponding scorotron charger 42, and is then exposed to LED light emitted from the LED head 31 of the corresponding LED unit 30. As a result, a potential of an exposed portion is lowered, and an electrostatic latent image is formed on the photoconductor drum 41 in accordance with the image data. Meanwhile, toner in the toner container 47 of each process cartridge 40 is supplied to the development roller 43 by the action of the rotating second and first supply rollers 45 and 44, and is then forwarded in between the development roller 43 and the doctor blade 46 by the action of the rotating development roller 43, to form a thin layer of toner having a uniform thickness retained on the development roller 43.

Toner is supplied from the development roller 43 to the photoconductor drum 41 as the development roller 43 rotates and toner retained on the development roller 43 comes in contact with the opposed surface of the photoconductor drum 41. At this time, toner is retained selectively on a part of the photoconductor drum 41 (in which an electrostatic latent image has been formed), which visualizes the electrostatic latent image to form a toner image thereon. The toner images in different colors formed on the photoconductor drums 41, respectively, are transferred onto the intermediate transfer belt 51 one on top of another by the action of the corresponding primary transfer rollers 52 to which a transfer bias is applied.

The toner image carried on the intermediate transfer belt 51 is transferred onto a sheet P by the action of the secondary transfer roller 53 to which a transfer bias is applied, as the sheet P fed into the image forming unit 5 passes between the intermediate transfer belt 51 and the secondary transfer roller 53. The sheet P onto which the toner image has been transferred is conveyed to the fixing unit 60, in which the toner image is fused and fixed by heat while passing between the heating roller 61 and the pressure roller 62. The sheet P on which the toner image has been thermally fixed is ejected by the sheet output roller 6 to the outside of the body casing 2; sheets P thus ejected from the body casing 2 are stacked and accumulated on the sheet output tray 2B.

The control circuit board 7 is configured to control emission of light of the LEDs of each LED head 31 by a known method, i.e., by means of a signal which the control circuit board 7 provides to the LEDs, in accordance with data of an image to be formed. The control circuit board 7 is, as shown in FIG. 1, disposed above the sheet feed cassette 71, and below and opposite to the support frame 10. On an upper side of the control circuit board 7 in a position closer to a front end thereof is provided four connectors 7A as one example of a connector to which the cables 8 are connected. The connectors 7A are arranged in a direction (front-rear direction) of tandem arrangement of the photoconductor drums 41.

The cables 8 provide electric wiring configured to electrically connect each of the LED heads 31 with the control circuit board 7. The cables 8 comprise wires which are connected at one ends thereof (not shown) to the corresponding LED heads 31, extend therefrom out through a bottom panel 10E (see FIG. 3) of the support frame 10, and are connected at the other ends thereof to the corresponding connectors 7A of the control circuit board 7. The cables 8 routed through the bottom panel 10E extend rearward (in a direction opposite to a pull-out direction in which the support frame is allowed to be pulled out) along an underside of the support frame 10, and are folded back to change its direction from rearward to frontward at a rear-side folded portion 8A within the body casing 2, so as to extend frontward along a topside of the control circuit board 7 to the connectors 7A at which the cables 8 are connected to the control circuit board 7. To be more specific, the cables 8 extending rearward are bundled to form a flexible harness portion, and the folded portion 8A is formed in this harness portion (i.e., the cables 8 are folded back at a common point in the portion where all the rearward-extending cables 8 come together, in this embodiment). This common point (folded portion 8A) at which the cables 8 are folded back is configured to move according as the support frame 10 is pulled out, but to remain within the harness portion in which all the cables 8 are bundled together.

Figure 5:
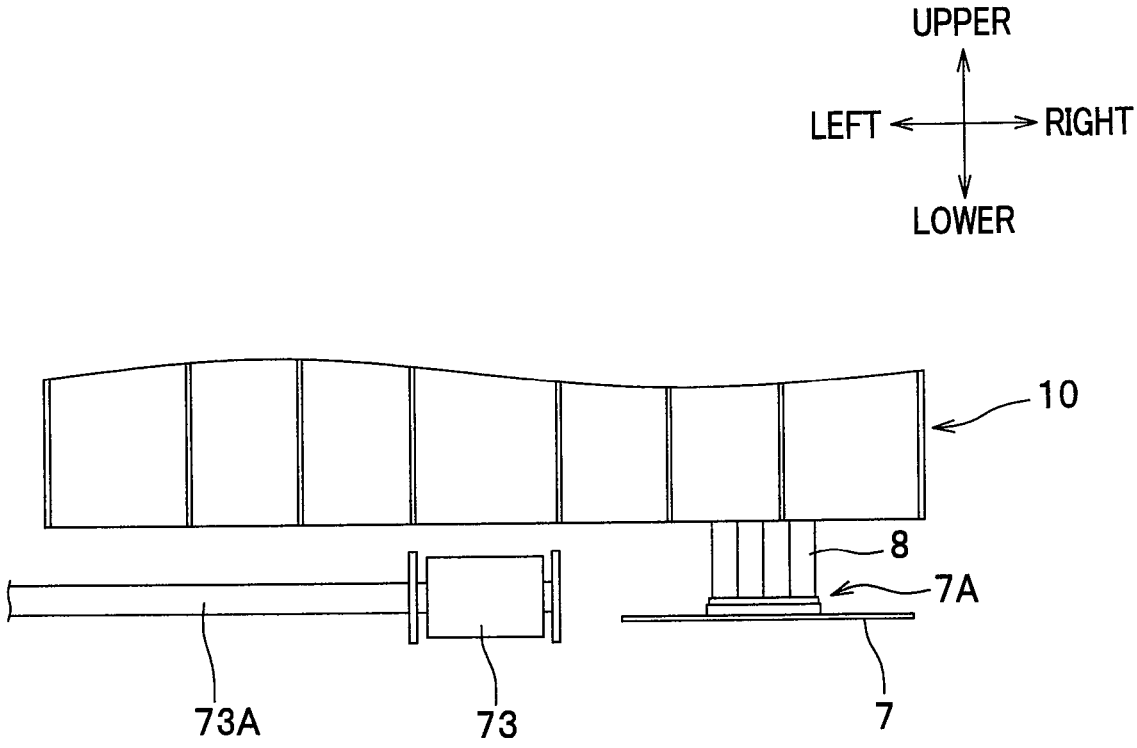
FIG. 5 is a front view showing an arrangement of the support frame, a sheet feed roller, a control circuit board and cables.

As shown in FIG. 5, the set of cables 8 and the control circuit board 7 are disposed off the sheet feed roller 73 as viewed from the front side, i.e., separate therefrom in the axial direction of the sheet feed roller 73, so that sheet feed roller 73 and the set of cables 8 (together with the control circuit board 7) are disposed horizontally without overlapping each other as viewed from the front side (pull-out direction). To be more specific, in a lower front-side space within the body casing 2, the sheet feed roller 73 disposed below the support frame 10 near a center of the width of the support frame 10 as viewed from the front side has a driving shaft 73A extending leftward from the sheet feed roller 73, a left end portion of the driving shaft 73A being coupled with a driving mechanism (not shown). On the other hand, the set of cables 8 and the control circuit board 7 are disposed at the right side of the sheet feed roller 73 (and the driving shaft 73A). That is, the set of cables 8 (together with the control circuit board 7) and the driving shaft 73A are located separately on the opposite sides (left and right sides) of the sheet feed roller 73.

The next discussion is directed to structures of the support frame 10 and the side frames 20 which will be described in detail with reference to FIGS. 6, 7A, 7B, 8A and 8B.

Figure 6:
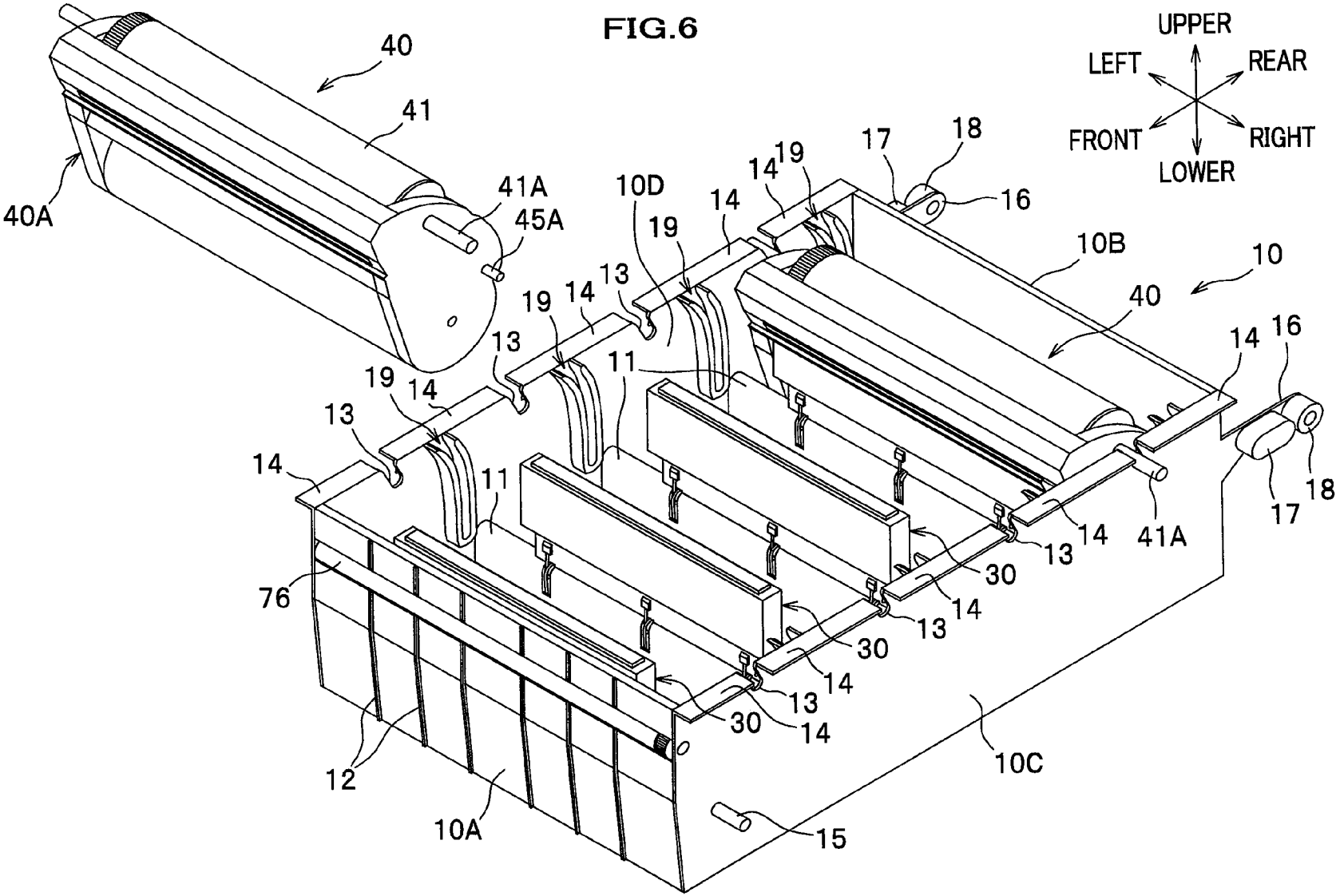
FIG. 6 is a perspective view of the support frame and the process cartridge.

As shown in FIG. 6, the support frame 10 is a member shaped like a box with its upper side open and is composed of a front panel 11A, a rear panel 10B, a right panel 10C, a left panel 10D and a bottom panel 10E (see FIG. 3).

In the front panel 10A, a first conveyor roller 76 is provided which is adapted to convey a sheet P upward along an outside of the front panel 10A, and a plurality of ribs 12 extending vertically are provided on the outside of the front panel 10A. The plurality of ribs 12 are intended to reduce the contact area of the front panel 10A with the sheet P to thereby prevent the sheet P, as conveyed, from adhering to the front panel 10A.

At an upper end of the right panel 10C, five flanges 14 are provided which are end portions of the panel 10C bent outward (to the right) substantially at right angles, and four recesses 13 each adapted to receive a shaft 41A of a corresponding photoconductor drum 41 are provided between the flanges 14, such that each shaft 41A of the photoconductor drum 41 can be removably placed in the recess 13. A protrusion 15 extending outward (to the right) is provided in a position on the outside of the right panel 10C closer to a front end thereof. Also provided in the right panel 10C is a roller mount portion 16 which projects rearward from around a midpoint of a rear end of the right panel 10C. On the roller mount portion 16, a columnar guide 17 and a rotatable guide roller 18 are arranged in this order from the front side, wherein the guide 17 is shaped like a column having a cross section of an elongated circle and projecting outward (to the right).

On an inside of the right panel 10C, four cartridge guide channels 19 are provided in each of which a shaft 45A of the corresponding second supply roller 45 (see FIG. 3) can be fitted, so as to guide the movement of the corresponding process cartridge 40 when the cartridge 40 is attached to or detached from the support frame 10. The process cartridge 40 attached to the support frame 10 is moved with its shaft 45A slid along the cartridge guide channel 19, and is thus removed in an obliquely frontwardly upward direction (as indicated by an arrow in FIG. 4).

The left panel 10D is provided with recesses 13, flanges 14, a protrusion 15, a roller mount portion 16, a guide 17, a guide roller 18, and cartridge guide channels 19, which are similar to the corresponding parts of the right panel 10C; i.e., the right and left panels 10C and 10D and their associated parts are arranged plane-symmetrically on the right and left sides of the support frame 10.

On the bottom panel 10E, four support stands 11 are provided to which the LED units 30 are tiltably (swingably) attached, as described above. The right and left ends of the support stands 11 are fixed to the right panel 10C and the left panel 10D, respectively. As a result, the support stands 11 serve as reinforcements for the support frame 10, thus enhancing the rigidity of the support frame 10.

Figure 7A:
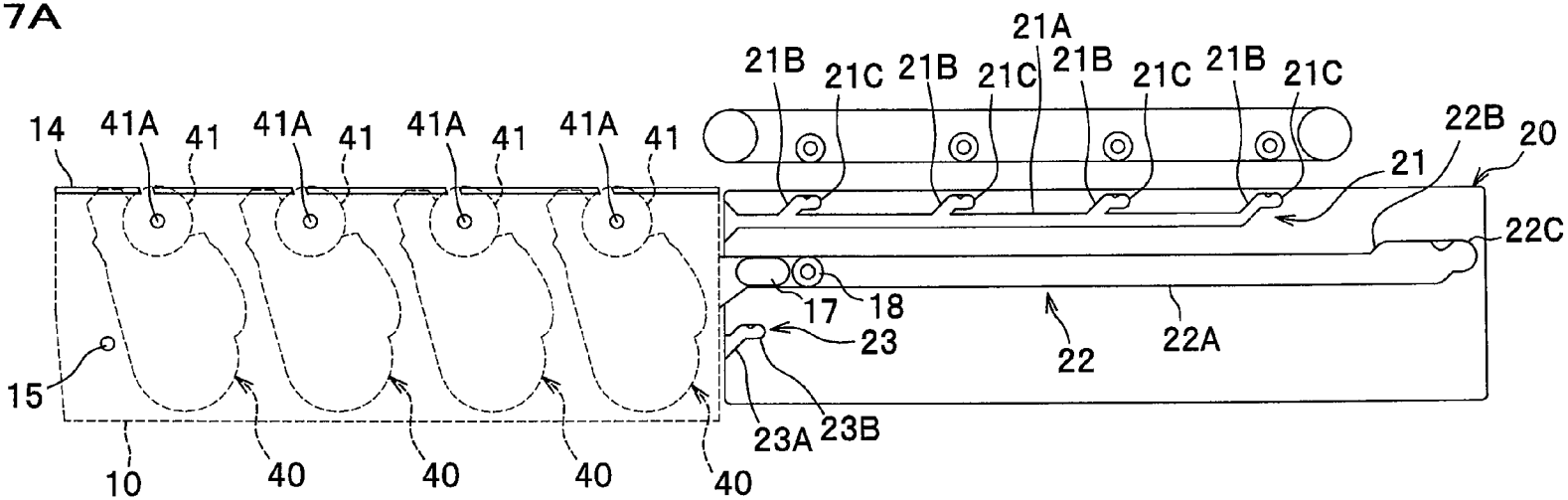
FIGS. 7A and 7B are diagrams for explaining a function of a guide channel and an operation of the support frame.

As shown in FIG. 7A, the side frames 20 are provided in a pair and disposed at left and right sides, respectively, (one at the right side is not shown) of the support frame 10 within the body casing 2. In each side frame 20, guide channels 21, 22 and 23 are formed. The guide channel 21 is configured to guide the shaft 41A of the photoconductor drum 41 supported by the recess 13 of the support frame 10. The guide channel 22 is configured to guide the guide 17 and the guide roller 18 of the support frame 10. The guide channel 23 is configured to guide the protrusion 15 of the support frame 10.

The guide channel 21 comprises a first guide portion 21A extending substantially horizontally in the front-rear direction, four second guide portions 21B extending from a rear end of the first guide portion 21A and from appropriately selected three spots on the first guide portion 21A respectively in an obliquely rearward and upward direction, and third guide portions 21C each extending substantially horizontally from a rear end of each second guide portion 21B in the rearward direction.

Figure 7B:
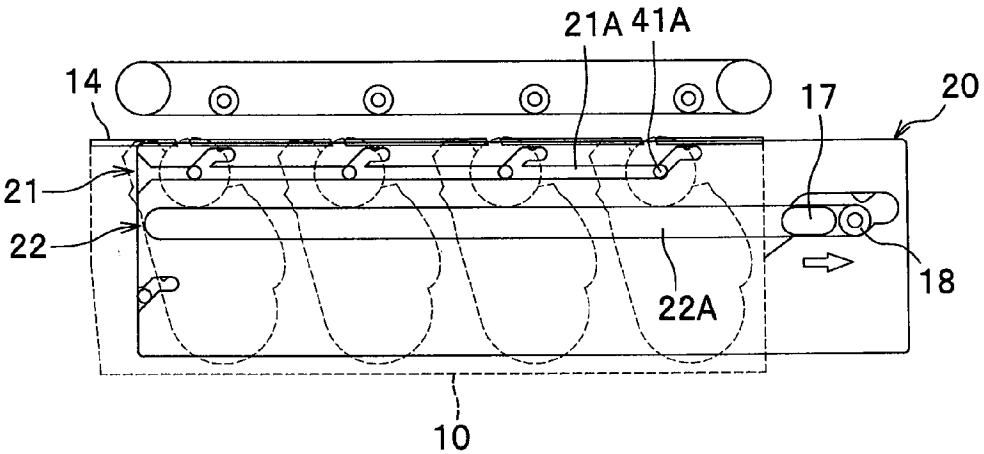

The guide channel 22, similar to the guide channel 21 as described above, comprises a first guide portion 22A extending substantially horizontally in the front-rear direction, a second guide portion 22B extending from a rear end of the first guide portion 22A in an obliquely rearward and upward direction, and a third guide portion 22C extending substantially horizontally from a rear end of the second guide portion 22B in the rearward direction. It is to be noted that a front end (left-hand end in FIGS. 7A and 7B) of the guide channel 22 (first guide portion 22A) is closed, as seen in FIG. 7B. This closed end serves to block excessive frontward movement of the guide 17, thus preventing the support frame 10 from falling out of the side frame 20 (body casing 2).

The guide channel 23 comprises a guide portion 23A extending from a front end of the side frame 20 in an obliquely rearward and upward direction, and an anchor portion 23B extending substantially horizontally from a rear end of the guide portion 23A in the rearward direction.

A description will now be given of the operation of a color multifunction printer 1 configured as described above.

At the outset, the operation of installing a process cartridge 40 to the support frame 10 will be described. When the shaft 45A of the second supply roller 45 of the process cartridge 40 is inserted in a direction as indicated by an arrow shown in FIG. 4 into the cartridge guide channel 19 of the support frame 10, the upper end of the LED unit 30 is fitted into a hollow 40B for exposure provided in the cartridge frame 40A, and the LED unit 30 is tilted to the rear. Once the top end of the frame part 32 comes in contact with a positioning part 40C provided in the cartridge frame 40A, the arm part 33 is forced into the frame part 32 as the coil spring 35 is compressed.

As seen in FIG. 3, when the shaft 45A is fitted completely into the cartridge guide channel 19, the shaft 41A is received by the recess 13, and a stopper member 13A composed of a leaf spring engages with the shaft 41A (see broken lines in FIG. 4). In this state, the arm part 33 is fitted completely in the frame part 32, and the coil spring 35 is fully compressed. Accordingly, a biasing force is applied to the LED head 31 in a radial direction (as indicated by an arrow X) of the photoconductor drum 41, and the frame part 32 and the positioning part 40C are brought into contact with each other without fail, whereby the LED head 31 can be properly positioned.

Next, the operation of setting the support frame 10 in the side frame 20 (body casing 2) will be described. As shown in FIG. 7A, when the support frame 10 is pushed rearward, the guide 17 and the guide roller 18 are guided by and moved along the first guide portion 22A of the guide channel 22 from the front toward the rear. In this operation, the shafts 41A of the photoconductor drums 41, sequentially from the rearmost-installed one, are fitted into the guide channel 21, and guided to move from the front toward the rear along the first guide portion 21A.

Figure 8A:
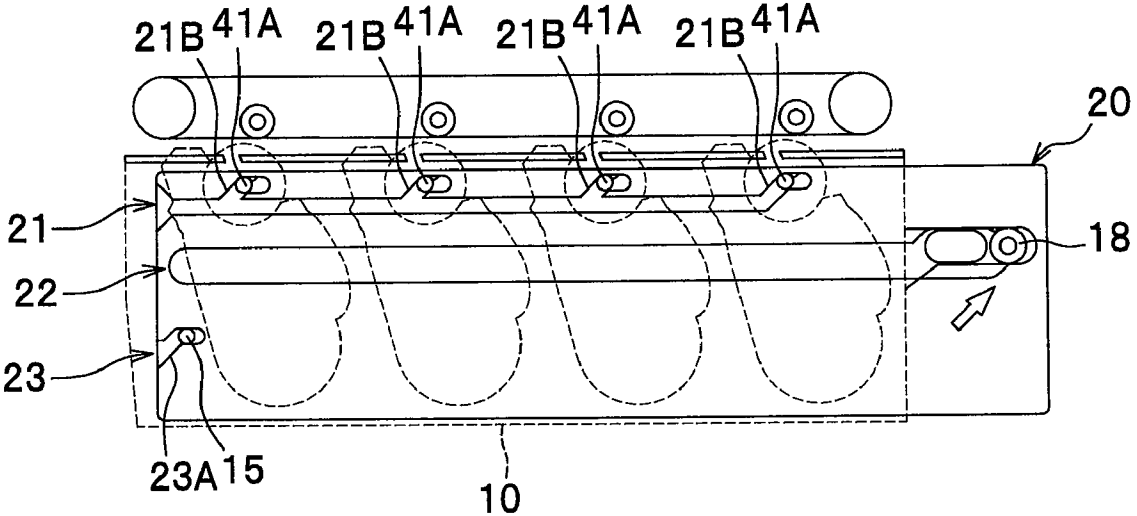
FIGS. 8A and 8B are diagrams for explaining a function of a guide channel and an operation of the support frame.
Figure 8B:
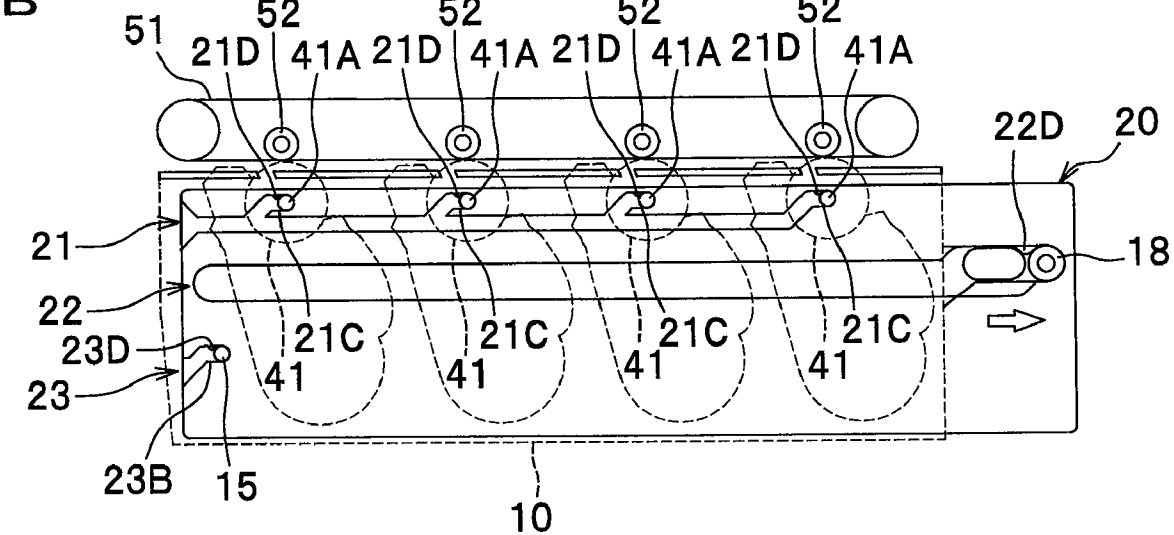

When the shaft 41A of the rearmost-installed photoconductor drum 41 comes in contact with the rear end of the first guide portion 21A and the guide roller 18 comes in contact with the rear end of the first guide portion 22A as shown in FIG. 7B, the support frame 10 is further pushed rearward. Then, as shown in FIG. 8A, the guide roller 18 and the shafts 41A are guided to move in an obliquely upward and rearward direction along the second guide portions 22B and 21B. In this operation, the protrusion 15 fitted in the guide channel 23 is guided to move in an obliquely upward and rearward direction along the guide portion 23A.

When the support frame 10 is further pushed rearward, each of the shafts 41A reaches the rear end of the corresponding third guide portion 21C and is engaged with a corresponding positioning part 21D made of a leaf spring, whereby each shaft 41A is positioned properly in the side frame 20. In this state, an upper side of each photoconductor drum 41 and a lower side of the corresponding primary transfer roller 52 are opposed to each other across the intermediate transfer belt 51. Moreover, the guide roller 18 and the protrusion 15 reach the rear ends of the third guide portion 22C and the anchor portion 23B, respectively, and are engaged with stopper members 22D and 23D each comprised of a leaf spring, whereby the guide roller 18 and the protrusion 15 are positioned properly in the side frame 20, respectively.

In this way, each photoconductor drum 41 can be positioned appropriately in the body casing 2; and also relative to the corresponding primary transfer roller 52, while the support frame 10 can be positioned appropriately relative to the side frame 20 (body casing 2). Almost all the time during the movement of the photoconductor drums 41 in the front-rear direction, each photoconductor drum 41 is kept separate from the intermediate transfer belt 51, so that any damage to the surfaces of each photoconductor drum 41 and the intermediate transfer belt 51 can be prevented or suppressed.

Thereafter, as shown in FIG. 1, when the front cover 2A is closed, the secondary transfer roller 53 and the driving roller 54 are opposed to each other across the intermediate transfer belt 51, and the first conveyor roller 76 and the second conveyor roller 77 are opposed to each other. Resultantly, the printer 1 has become ready for its image-forming process.

Next, the motion of the cables 8 upon manipulation of the support frame 10 for attaching thereto or detaching therefrom a process cartridge 40 will be described. As shown in FIG. 1, when the support frame 10 is fully accommodated in the body casing 2, the folded portion 8A of the set of cables 8 is located rearwardly of the rear panel 10B (see FIG. 6) of the support frame 10. As shown in FIG. 2, when the front cover 2A is opened and the support frame 10 is pulled out toward the front, spots on the bottom panel 10E at which the cables 8 are led out from the support frame 10 (through the bottom panel 10E) move frontward; accordingly, an upper portion of the cables 8 located frontwardly of the folded portion 8A is pulled due to its connection with the bottom panel 10E at these spots, and thereby moves frontward as well. In this process, the folded portion 8A of the set of cables 8 is shifted from the rear to the front; i.e., the position of the folded portion 8A is moved relatively from the rear to the front within a harness portion where all the rearward-extending cables 8 come together. Therefore, entanglement of the cables 8 can be prevented so that the support frame 10 can be pulled out smoothly.

On the other hand, when the support frame 10 is pushed in rearward, the spots on the bottom panel 10E at which the cables 8 are led out from the support frame 10 move rearward; accordingly, an upper portion of the set of cables 8 located frontwardly of the folded portion 8A is pushed due to its connection with the bottom panel 10E at these spots, and thereby moves rearward as well. In this process, the folded portion 8A of the set of cables 8 is shifted from the front to the rear; i.e., the position of the folded portion 8A is moved relatively from the front to the rear within a harness portion where all the rearward-extending cables 8 come together. Therefore, entanglement of the cables 8 can be prevented so that the support frame 10 can be pushed in smoothly.

It is to be noted that the set of cables 8 and the sheet feed roller 73 are, as shown in FIG. 5, disposed laterally (so as to be shifted along the direction of extension of the driving shaft 73A) without overlapping each other as viewed from the front direction, so that the set of cables 8 can be moved in the front-rear direction without interfering with the sheet feed roller 73.

With the features of the present embodiment as described above, the following advantageous effects can be achieved.

The LED heads 31 are mounted to the support frame 10, and the LED heads 31 and the control circuit board 7 are connected to each other by the set of cables 8 having the folded portion 8A movable in position within a harness portion of the set of cables 8, so that the support frame 10 can be pulled out together with the LED heads 31. Further with this configuration, each of the LED heads 31 (LED units 30) does not have to be moved away upward from a position in which each LED head 31 is disposed opposite to the corresponding photoconductor drum 41, and thus the color multifunction printer 1 can be placed even in a position where no ample space is provided above. Moreover, the flatbed scanner 3 can be provided above the body casing 2, and the space above the body casing 2 can be utilized effectively.

Since the support frame 10 can be pulled out frontward (horizontally), the support frame 10 can be moved more easily in comparison with the case where the heavy support frame by which a plurality of process cartridges are supported is slid upward. Moreover, since the support frame 10 is allowed to be pulled out from the body casing 2 in a direction of tandem arrangement of the photoconductor drums 41, a process cartridge 40 which accommodates black toner (a toner which is likely to be consumed more rapidly than others) and thus should be replaced more frequently may be arranged at the frontmost position so that solely a single process cartridge of black color can be replaced with increased ease. Furthermore, since the shaft 41A of each photoconductor drum 41 may be arranged to protrude from the right and left panels of the support frame 10, the photoconductor drum 41 can be properly positioned in the body casing 2 (side frame 20). Accordingly, the balance of contact between each photoconductor drum 41 and the intermediate transfer belt 51 can be kept substantially constant; thus, a high image quality can be maintained as a result.

Since each LED head 31 is disposed below the corresponding photoconductor drum 41, the LED head 31 does not have to be moved away before replacement of the process cartridge 40. Moreover, since each LED unit 30 is configured to be tiltable and the process cartridge 40 is configured to be attachable from above the support frame 10, the process cartridge 40 can be attached and detached easily without interfering with the LED unit 30.

Since the LED unit 30 is configured to be tiltable (swingable) with respect to the support frame 10, the intervals between adjacent process cartridges 40 may be designed to be smaller than the case where each exposure unit is fixed in an obliquely rearward and upward direction. Therefore, the support frame 10 can be designed to be compact, and thus the color multifunction printer 1 can be miniaturized as a result. Moreover, since the LED unit 30 is tiltable (swingable), the process cartridge 40 can be attached to the support frame 10 so as to be detachable therefrom in an obliquely frontward and upward direction, the process cartridge 40 can be detached from and attached to the support frame 10 with increased ease. Furthermore, when the process cartridge 40 is removed, the LED head 31 is oriented upright by the action of the torsion spring 34; therefore, the positioning of the hollow 40B for exposure on the LED unit 30 is facilitated so that the process cartridge 40 can be installed with increased ease.

Since the intermediate transfer belt 51 is provided above the photoconductor drums 41, the conveyance path for sheets P can be simplified, and the vertical dimension of the body casing 2 can be reduced in comparison with the case where the photoconductors are arranged vertically; thus, the color multifunction printer 1 can be miniaturized as a result. Moreover, since the secondary transfer roller 53 is provided frontwardly of the intermediate transfer belt 51, a jam of sheets P at a position where a transfer process is performed can be handled from the front side. In particular, since the secondary transfer roller 53 is attached to the front cover 2A, a jam of sheets P can be made handleable with increased ease by simply opening the front cover 2A.

Since the first conveyor roller 76 is mounted directly to the support frame 10 (front panel 10A), the body casing 2 can be designed to be smaller in the front-rear direction, and thus the color multifunction printer 1 can be miniaturized as a result. Moreover, since the second conveyor roller 77 opposite to the first conveyor roller 76 is mounted to the front cover 2A, a jam of sheets P can be made handleable with increased ease by simply opening the front cover 2A.

In the present embodiment, the folded portion 8A of the set of cables 8 is provided in a rearward position in the body casing 2. Since the position of the folded portion 8A is relatively shifted frontward according as the support frame 10 is pulled out, the support frame 10 can be pulled out smoothly from the body casing 2 without causing entanglement of the cables 8. Moreover, since the position of the folded portion 8A is relatively shifted rearward according as the support frame 10 is pushed in, the support frame 10 can be pushed smoothly in the body casing 2 without entanglement of the cables 8.

Since the control circuit board 7 is disposed below the support frame 10, space between the sheet feed cassette 71 and the support frame 10 (space in the body casing 2) can be utilized effectively. Moreover, interference that would otherwise occur between the control circuit board 7 and a driving mechanism (not shown) for the process cartridge(s) 40 provided on the right or left side (or on the both sides) of the support frame 10 can be prevented.

Since the connectors 7A are provided in a position on the control circuit board 7 closer to the front end thereof, a sufficient length of the set of cables 8 having a folded portion 8A in a position in the body casing 2 closer to the rear side thereof can be ensured. Accordingly, the distance of pulling out of the support frame 10 can be made longer, so that the rearmost-mounted process cartridge 40 can be replaced with increased ease.

Since the control circuit board 7, the cables 8 and the sheet feed roller 73 are disposed laterally, the vertical dimension of the body casing 2 can be reduced in comparison with the case where the control circuit board and/or wires are disposed above or below the sheet feed roller. Consequently, the color multifunction printer 1 can be designed to be thinner in a vertical direction, so that the color multifunction printer 1 can be installed even in a position where no ample space is provided above.

Although some exemplary embodiments of the present invention have been described above, the present invention is not limited to these embodiments, and may be carried out into practice in various other ways. Thus, it is contemplated that various modifications and changes may be made to the exemplary embodiments of the invention without departing from the scope of the present invention as defined in the appended claims.

In the above-described embodiment, a color multifunction printer 1 have been illustrated and described as an example of an image forming apparatus consistent with the present invention, the present invention is not limited thereto. In other words, the present invention is also applicable to color photocopiers, or color LED printers having no image reader (flatbed scanner), or the like.

In the above-described embodiment, a cartridge is designed as a process cartridge 40 which is a single cartridge containing a photoconductor drum 41, a development roller 43 and a toner container 47, but the present invention is not limited to this particular configuration. For example, a cartridge consistent with the present invention comprises a photoconductor drum (photoconductor) but the development roller and the toner container may be contained in another cartridge which is configured to be separable from the cartridge containing the photoconductor drum (photoconductor) Alternatively, another cartridge containing the development roller and still another cartridge containing the toner container (i.e., toner cartridge) may be provided separably from the cartridge containing the photoconductor drum (photoconductor).

Although the LED heads 31 using light-emitting diodes (LEDs) as luminescent elements have been described above exemplarily as one example of a plurality of exposure units, the present invention is not limited to this particular embodiment. That is, the luminescent elements applicable as consistent with the present invention may not necessarily be LEDs, but a number of arrayed elements of any kinds which can emit light selectively based upon image data, such as electroluminescent (EL) devices, or other devices using luminescent material, may be employed, instead. Further, a number of arrayed optical shutters (e.g., those made of liquid crystal or PLZT material) capable of controlling light from one or more luminescent elements (light sources) may be employed in each exposure unit to selectively control the times of opening and closing the shutters based upon image data.

Although the above-described embodiment has illustrated a particular configuration in which the control circuit board 7 is disposed below and opposite to the support frame 10, but the present invention is not limited thereto. For example, the control circuit board may be disposed either beside or above, and opposite to, the support frame. In this instance, the control circuit board may be disposed only on one side of the support frame, or may be divided into two boards to be disposed on both sides of the support frame.

Although the above-described embodiment has illustrated a particular configuration in which the support frame is pulled out from the front side of the body casing 2 in the front-rear direction (direction of tandem arrangement of the photoconductor drums 41), the present invention is not limited thereto. Any other configuration in which the support frame is pulled out horizontally from any side of the body casing (casing of the apparatus) may be applicable. For example, the support frame in an alternative embodiment may be pulled out from the right or left side of the casing of the apparatus, laterally (i.e., in a direction perpendicular to the direction of tandem arrangement of the photoconductors).

Furthermore, in the above-described embodiment, the photoconductor drum 41, torsion spring 34 and coil spring 35 are adopted as examples of a photoconductor, a first biasing element and a second biasing element, respectively. However, the present invention is not limited thereto. That is, the material and/or structure of these elements may be changed or modified where appropriate without departing from the scope of the present invention.

Figure 9:
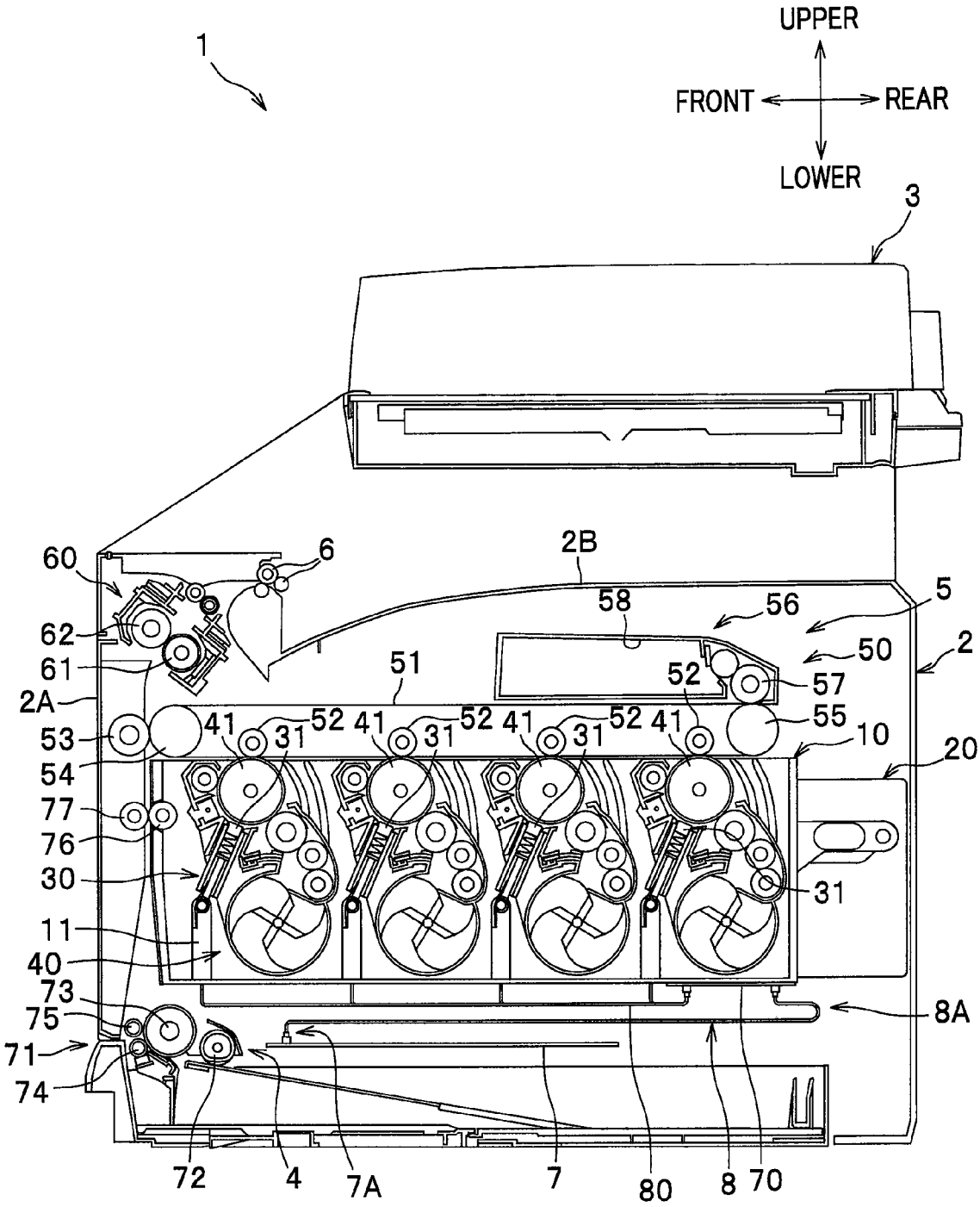
FIG. 9 a sectional view showing a general construction of a color multifunction printer according to another exemplary embodiment of the present invention.

In the above-described embodiment, four LED heads 31 and the control circuit board 7 are electrically connected by the cables 8 which consist of four corresponding wires, but the present invention is not limited to this particular embodiment. For example, as shown in FIG. 9, a support frame-side board 70 may be additionally provided in a position, on the underside of the support frame 10 (the bottom panel 10E), closer to the rear end thereof. In this alternative embodiment, the support frame-side board 70 may be electrically connected with the control circuit board 7 by a cable (or a set of cables) 8, and the support frame-side board 70 may be electrically connected with each of the LED heads 31 by support frame-side cables 80. The control circuit board consistent with the present invention may not be configured to perform all the aspects of control over the exposure units, but may be configured to perform some of the aspects of control while the other aspects of control may be performed by one or more other circuit boards (e.g., support frame-side board 70, etc.).

The cables 8 shown in FIG. 1 or the support frame-side cables 80 shown in FIG. 9 are illustrated to be routed through the bottom panel 10E into the support frame 10, but the present invention is not limited to this particular configuration. For example, the cables may be routed through a hole provided in a lower part of the rear panel 10B into the support frame 10, and pass along the upper side of the bottom panel 10E or inner sides of the left or right side panel, to connect to the corresponding LED heads 31.

What is claimed is:

1. An image forming apparatus comprising:

a plurality of cartridges each of which includes a photoconductor;

a support frame configured to support the cartridges arranged in tandem, the support frame being allowed to be pulled out horizontally from a casing of the apparatus to a position in which each of the cartridges is detachable from the support frame;

a plurality of exposure units mounted to the support frame, wherein each of the exposure units is disposed opposite to the corresponding photoconductor and is configured to expose the photoconductor to light, thereby forming an electrostatic latent image thereon;

a control circuit board which is disposed opposite to the support frame and is configured to control each of the exposure units; and electric wiring configured to electrically connect each of the exposure units with the control circuit board;

wherein the electric wiring comprises a cable, and the cable extending from the support frame in a direction opposite to a pull-out direction in which the support frame is allowed to be pulled out is folded back and extends in the pull-out direction to the control circuit board; and wherein each of the cartridges is configured to be detachable in such a direction that the photoconductor in the cartridge moves away from the corresponding exposure unit upon detachment.

2. The image forming apparatus according to claim 1, wherein the cable comprises a plurality of wires which extend from the exposure units in the direction opposite to the pull-out direction, so as to be bundled together to form a harness portion in which the plurality of wires are folded back and extend in the pull-out direction to the control circuit board.

3. The image forming apparatus according to claim 1, wherein the control circuit board is disposed below the support frame.

4. The image forming apparatus according to claim 1, wherein the control circuit board comprises a connector to which the cable is connected, the connector being disposed in a position closer to a front end of the control circuit board facing toward the pull-out direction.

5. The image forming apparatus according to claim 1, further comprising a sheet feed roller disposed below a front side of the support frame facing toward the pull-out direction, wherein the sheet feed roller and the wiring are disposed horizontally without overlapping each other as viewed from the pull-out direction.

6. The image forming apparatus according to claim 1, wherein each of the exposure units is disposed below and opposite to the corresponding photoconductor, and each of the cartridges is detachable upwardly from the support frame.

7. The image forming apparatus according to claim 1, wherein the support frame is allowed to be pulled out from the casing of the apparatus in a direction of tandem arrangement of the plurality of cartridges.

* * * * *

UNITED STATES PATENT AND TRADEMARK OFFICE

CERTIFICATE OF CORRECTION

PATENT NO. : 8,311,437 B2
APPLICATION NO. : 12/255689
DATED : November 13, 2012
INVENTOR(S) : Shougo Sato It is certified that error appears in the above-identified patent and that said Letters Patent is hereby corrected as shown below:

On the Title page, Item (30) under Foreign Application Priority Data:
Please delete "Dec. 24, 2007" and insert --Dec. 27, 2007--

Signed and Sealed this
Thirteenth Day of August, 2013

Teresa Stanek Rea
*Acting Director of the United States Patent and Trademark Office*